US010050349B2

(12) United States Patent
Kroening

(10) Patent No.: US 10,050,349 B2
(45) Date of Patent: Aug. 14, 2018

(54) WAVEGUIDE WITH LOSSY BACK SHORT

(71) Applicant: Honeywell International Inc., Morris Plains, NJ (US)

(72) Inventor: Adam M. Kroening, Atlanta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 48 days.

(21) Appl. No.: 15/367,994

(22) Filed: Dec. 2, 2016

(65) Prior Publication Data

US 2018/0159236 A1 Jun. 7, 2018

(51) Int. Cl.
*H01Q 13/00* (2006.01)
*H01Q 13/02* (2006.01)

(52) U.S. Cl.
CPC ..... *H01Q 13/0233* (2013.01)

(58) Field of Classification Search
CPC ..... H01Q 13/02; H01Q 13/24; H01Q 15/02; H01Q 13/0233
See application file for complete search history.

(56) References Cited

U.S. PATENT DOCUMENTS 2,590,511 A 3/1952 Craig et al.
3,581,245 A 5/1971 Kunio et al.
4,906,952 A 3/1990 Praba et al.
5,132,646 A * 7/1992 Faxon ..... H01P 5/20 333/121
6,970,139 B1 11/2005 Chew et al.
7,002,429 B2 2/2006 Asao et al.
7,920,034 B1 4/2011 Sorensen et al.
2012/0171981 A1* 7/2012 Hiers ..... H01Q 13/0275 455/334
2014/0253263 A1 9/2014 Federmann et al.

FOREIGN PATENT DOCUMENTS

JP S5859204 U 4/1983

OTHER PUBLICATIONS

European Patent, "Extended European Search Report from EP Application No. 17194146.1 dated Apr. 25, 2018", "From Foreign Counterpart of U.S. Appl. No. 15/367,994", Apr. 25, 2018, pp. 110; Published in: EP.
Peter Lubell et al., "Using Double-Ridge Waveguide", "E.Z. Electronics", Oct. 5, 1962, pp. 1-5, US.

* cited by examiner

*Primary Examiner* — Dieu H Duong
(74) *Attorney, Agent, or Firm* — Fogg & Powers LLC

(57) ABSTRACT

A waveguide is provided. The waveguide comprises: a ridged waveguide section having a first end and an opposing second end, wherein the ridged waveguide section comprises an input port at the first end, and wherein the ridged waveguide section comprises at least one ridge formed within the ridged waveguide section extending into the ridged waveguide section along an axis normal to the input port; a rectangular waveguide section coupled to the second end; at least one tapered load element located in a non-ridge region of the ridged waveguide section, wherein the at least one tapered load element comprises a material configured to absorb a first portion of power propagating through the waveguide; and at least one lossy back load element within the rectangular waveguide section, wherein the at least one lossy back load element comprises a material configured to absorb a second portion of the power propagating through the waveguide.

20 Claims, 3 Drawing Sheets

WAVEGUIDE WITH LOSSY BACK SHORT

STATEMENT REGARDING FEDERALLY SPONSORED RESEARCH OR DEVELOPMENT

This invention was made with Government support under Government Contract Number FA8522-15-C-0008 awarded by The Air Force Sustainment Center. The Government has certain rights in the invention.

BACKGROUND

Various types of radio frequency (RF) network assemblies require the use of high power loads, with RF absorber material rated to 260° C. for its load component. However, conventional loads present difficulty in changing the size of the load components if requirements such as operating frequency or RF power levels change.

Specifically, conventional systems include high power loads that are generally made from long E-plane or H-plane tapers either bonded or screwed into a waveguide housing. In conventional systems, the length of these high power loads is proportionate with operating frequency and RF power levels. In many conventional systems, the length of the tapered loads is at least six inches long.

For the reasons stated above and for other reasons stated below, it will become apparent to those skilled in the art upon reading and understanding the specification, there is a need in the art for a waveguide structure that includes load elements that are able to absorb high power while minimizing the length of the load element.

SUMMARY

The Embodiments of the present invention provide methods and systems for providing a waveguide that is able to absorb high power while minimizing the length of the load element.

In one embodiment, a waveguide comprises: a ridged waveguide section having a first end and an opposing second end, wherein the ridged waveguide section comprises an input port at the first end of the ridged waveguide section, and wherein the ridged waveguide section comprises at least one ridge formed within the ridged waveguide section extending into the ridged waveguide section along an axis normal to the input port; a rectangular waveguide section coupled to the second end of the ridged waveguide section; at least one tapered load element located in a non-ridge region of the ridged waveguide section, wherein the at least one tapered load element comprises a material configured to absorb a first portion of power propagating through the waveguide; and at least one lossy back load element within the rectangular waveguide section, wherein the at least one lossy back load element comprises a material configured to absorb a second portion of the power propagating through the waveguide.

DRAWINGS

Understanding that the drawings depict only exemplary embodiments and are not therefore to be considered limiting in scope, the exemplary embodiments will be described with additional specificity and detail through the use of the accompanying drawings, in which.

Figure 1:
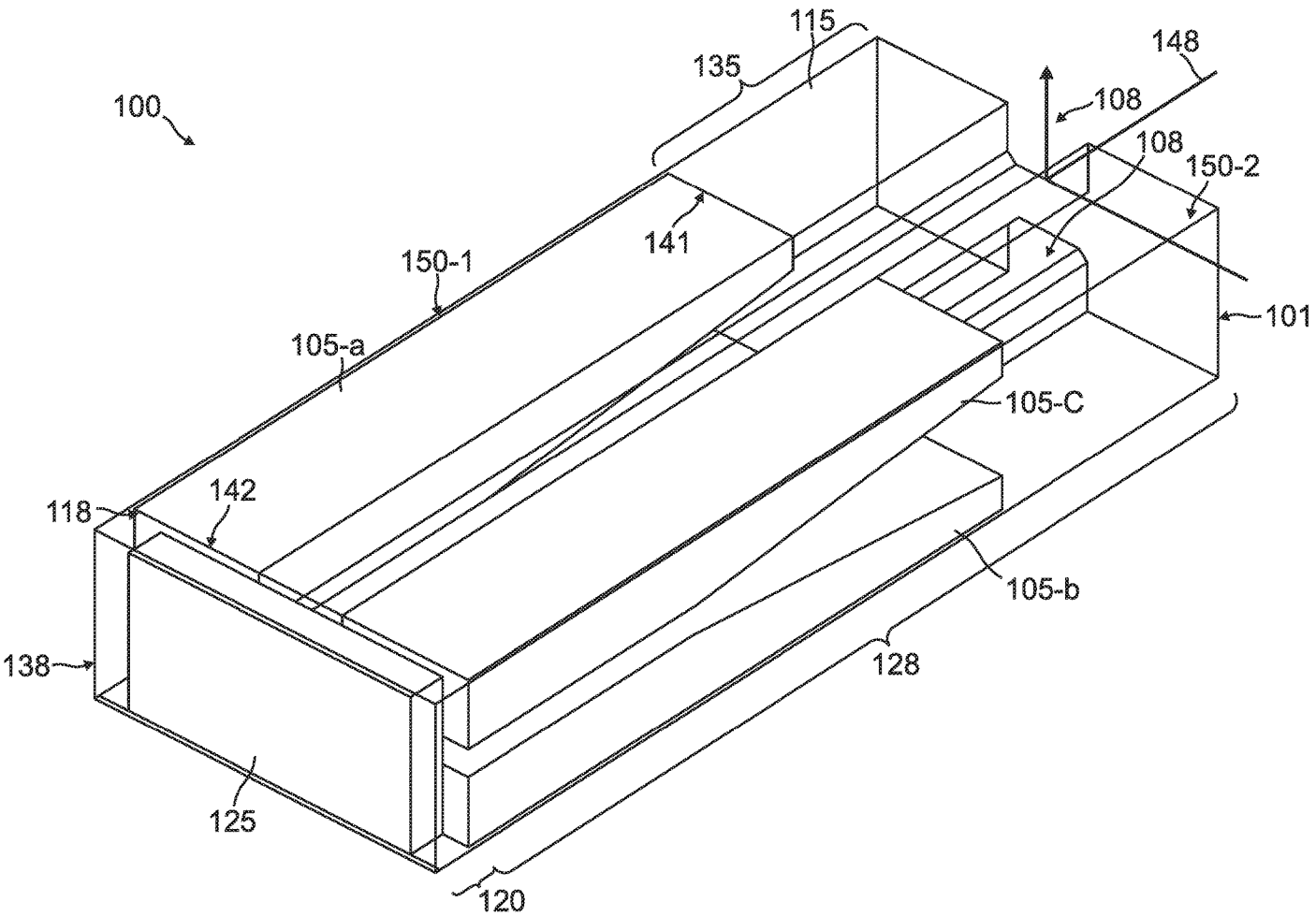
FIG. 1 is a perspective view of an example load component of a waveguide.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

Embodiments of the present description provide systems and methods for compact waveguide load elements that are shorter, and thus require less physical space, than conventional high power load designs. Specifically, a combination of tapered load element(s) and a lossy back load element within a waveguide housing allow high power introduced into a waveguide to be absorbed more efficiently than conventional load designs, so that the overall length need not be as long as conventional load designs. As explained below, as a signal is introduced into the waveguide, some of the power of that signal is absorbed by the tapered element(s) while remaining power not absorbed by the tapered element(s) is absorbed by a lossy back load element.

FIG. 1 is a perspective view of an example waveguide 100 of one embodiment of the present disclosure. Waveguide 100 comprises a housing (not shown) that includes at least one ridge 108. In some implementations, waveguide 100 is a single ridge waveguide and includes only one ridge 108. In the example shown in FIG. 1 and FIG. 2, waveguide 100 is a double ridge waveguide wherein the housing would include at least two ridges 108. As used herein, a ridge refers to a longitudinal protrusion that extends from the walls of the housing of waveguide 100 into an interior volume of waveguide 100.

Waveguide 100 further includes a ridge waveguide section 128 and a rectangular waveguide section 120. Ridge waveguide section 128 has a first end 101 and a second end 118, wherein the first end 101 is opposite the second end 118. An input port to waveguide 100 is formed by the first end 101 and is therefore also referred to herein as input port 101. Radio frequency (RF) energy enters into the waveguide 100 through the input port on the first end 101. Further, as shown in FIG. 1, ridge 108 extends through ridge waveguide section 128. In some implementations, ridge 108 runs longitudinally down the middle of the waveguide 100 such that ridge 108 is equidistant from its two outer edges 150-1 and 150-2. Accordingly, in the particular dual-ridge configuration implementation illustrated in FIG. 1, the two ridges 108 protruding into the internal volume of the waveguide 100 along an axis 148 normal to the input port 101 defines an elongated H-shaped ridge waveguide section 128. That is, waveguide section 128 is defined by having an H-shaped cross section.

The internal volume of waveguide 100 further includes within the waveguide section 128 one or more tapered load elements 105 (indicated by 105-*a, b, c* and *d*) that are placed in non-ridge sections 115 of the ridged waveguide for absorption of at least a portion of the power that enters through input port. Each tapered load elements 105 has one thin edge 141 and a thick edge 142, wherein the thick edge 142 is opposite the thin edge 141. The thin edge 141 is oriented towards the input port 101 and the thicker edge 142 is oriented away from the input port 101. This configuration provides for the gradual absorption of RF power as it enters through the input port 101. This gradual absorption provided by this configuration also prevents too much absorption of high power at the input port 101, which assists in avoiding excessive heating of the load.

In some implementations, the tapered load element(s) 105 taper for a first portion of the total length of the tapered load element 105 and remains constant for the rest. For example, in one embodiment, the first two thirds of the total length of the tapered load element 105 is tapered but remains constant in height for the final third. In some implementations, the length of the tapered load element(s) 105 from thin edge 141 to thick edge 142 is less than two inches. The shape and the angle of tapered load element 105 depends on the requirements of return loss. In some implementations, one or more tapered load element(s) 105 are tapered along the H-plane. In some implementations, one or more tapered load element(s) 105 are tapered along the E-plane. In some implementations, one or more tapered load element(s) 105 are tapered in the XY planes when the RF energy is propagating in the z-direction. In some implementations, one or more tapered load element(s) 105 taper conically, in that, the tapering of tapered load element(s) 105 begins at a point 141 and curves out in a cone shape until edge 142.

In some implementations, the tapered load element(s) 105 ends at the second end 118 of the ridge waveguide section 128 such that the thick edge of the tapered load element(s) 105 is aligned with the second end 118 of the ridge waveguide section 128. In some implementations, the tapered load element(s) 105 are spaced at a distance from the second end 118 of the ridge waveguide section 128. In some implementations, the distance is less than 0.25 millimeters. In some implementations, the tapered load element(s) 105 is spaced at a distance 135 from input port 101. In some implementations, distance 135 is 0.25 millimeters.

Waveguide 100 further includes a rectangular waveguide section 120. Rectangular waveguide section 120 includes second end 118 and a third end 138 that is opposite the second end 118. Accordingly, rectangular waveguide section 120 is adjacent to the second end 118 of ridge waveguide section 128. As shown in FIG. 1, rectangular waveguide section 120 is adjacent to thick edge 142 and farther away from thin edge 141. Unlike ridge waveguide section 128, rectangular waveguide section 120 does not include a ridge. In some implementations, the height and width of rectangular waveguide section 120 may be equal to the height and width of ridge waveguide section 128.

At least one lossy back load element 125 is placed in rectangular waveguide section 120 for absorption of any power remaining after absorption by tapered load element(s) 105, essentially forming a lossy back short. In some implementations, lossy back load element 125 is placed in rectangular waveguide section 120, such that it is adjacent to ridge 108. In some implementations, lossy back load element is non-adjacent to ridge 108. In some implementations, lossy back load element 125 is placed in rectangular waveguide section 120, such that it is adjacent to third end 138. In some implementations, lossy back load element is non-adjacent to third end 138. In some implementations, lossy back load element 125 is a rectangular load element. In some implementations, lossy back load element 125 is less than ten percent the length of tapered load element(s) 105.

In operation, when an RF signal enters into waveguide 100 at the input port 101, at least a portion of the power of the RF signal is absorbed by the tapered load element(s) 105, and the remaining power propagating through waveguide 100 is absorbed by lossy back load element 125. In the examples shown in FIGS. 1 and 2, waveguide 100 is a double ridged waveguide having four tapered load elements 105*a*, 105*b*, 105*c* and 105*d* in one of the four quadrants. When the RF energy enters the input port, the four tapered load elements 105*a*, 105*b*, 105*c*, and 105*d* absorb at least a portion of the power and the remaining power is received and absorbed by lossy back load element 125. In one implementation, the four tapered load elements absorb at least 50% of the power, and the remaining is absorbed by lossy back load element 125.

Depending on power levels, lossy back load element 125 may be composed of a material different than tapered load element 105. In some implementations, lossy back load element 125 and tapered load element(s) 105 are composed of the same absorptive material. In one implementation, one or more tapered load element(s) 105 are composed of high temperature absorptive material. In one implementation, at least one lossy back load element 125 is composed of high temperature absorptive material. For example, in some implementations, the high temperature absorptive material may be an RF absorber material rated to higher than 260° C. In further examples of this implementation, the high temperature absorptive material may be an RF absorber material rated to at least 1000° C.

In one implementation, one or more tapered load element(s) 105 is composed of low temperature rated absorptive material. In one implementation, at least one lossy back load element 125 is composed of low temperature rated absorptive material. For example, in some implementations, depending on power levels, if most of the power can be absorbed by one or more tapered elements 105, lossy back load element 125 may be made from a low temperature rated absorptive material.

Figure 2:
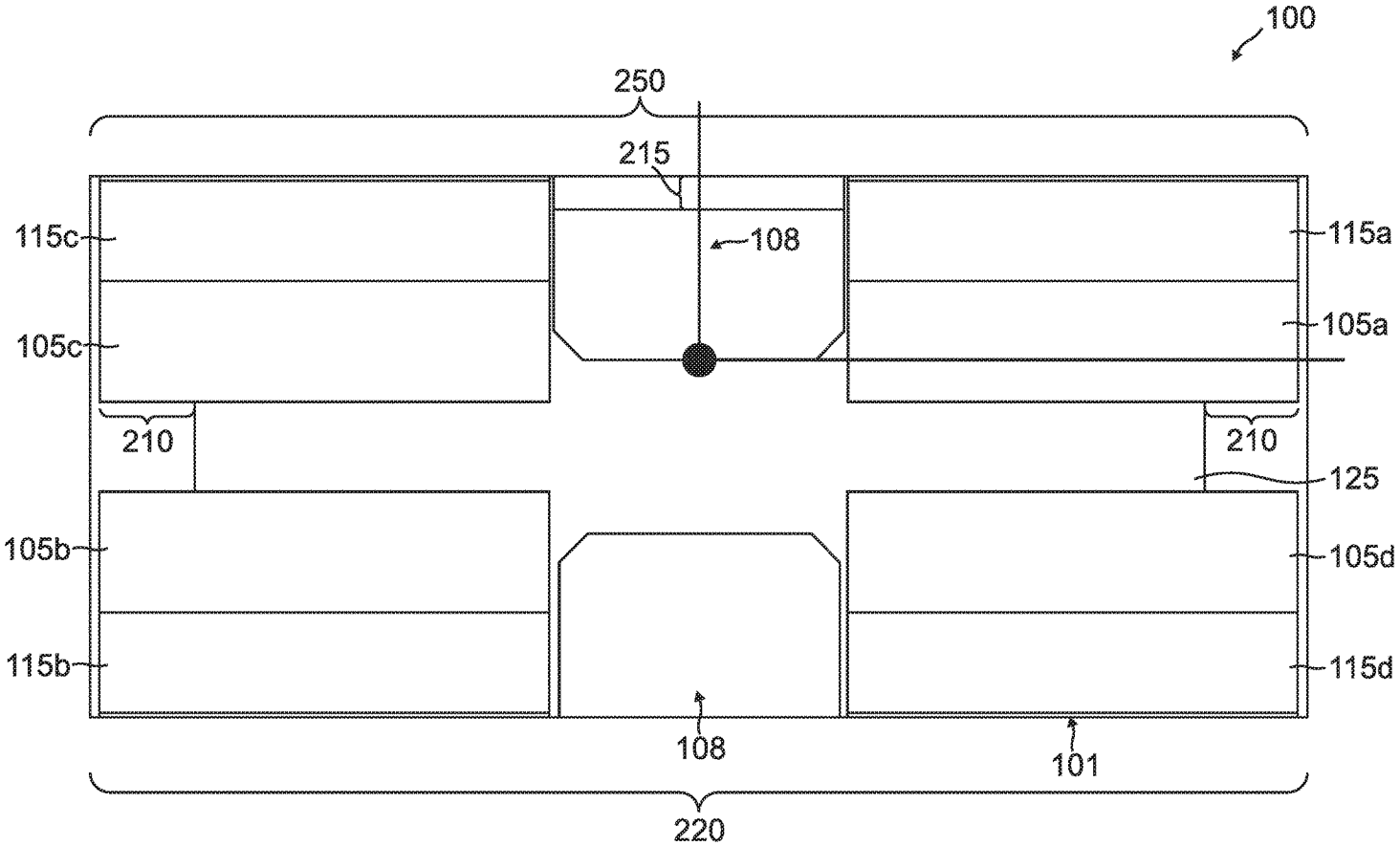
FIG. 2 is a view from an input port of the example load component of the example waveguide of FIG. 1.

FIG. 2 is a view looking into the input port 101 of the waveguide 100 embodiment discussed in FIG. 1. In the example shown in FIG. 2, the lossy back load element 125 is a rectangular load element. In some implementations, lossy back load element 125 has different dimensions from the rectangular waveguide section 120. As shown in FIG. 2, rectangular waveguide section 120 has given width (220). Lossy back load element 125 is shorter (215) and narrower (210) than rectangular waveguide section 120.

Returning briefly back to FIG. 1, the thickness of lossy back load element 125 depends on power and frequency of the RF energy entering the input port, and further depends on the absorption capability of tapered load elements 105. The lossy back load element 125 has to have enough thickness to absorb any power remaining after the RF energy has propagated through the ridge waveguide section 128. Accordingly, lossy back load element 125 may have a thickness that is 10 percent of the length of the tapered load elements 105 of waveguide 100. In one implementation, the at least one lossy back load element 125 and one or more tapered load element(s) 105 of waveguide 100 provide a return loss of greater than or equal to 10 decibels.

Figure 3:
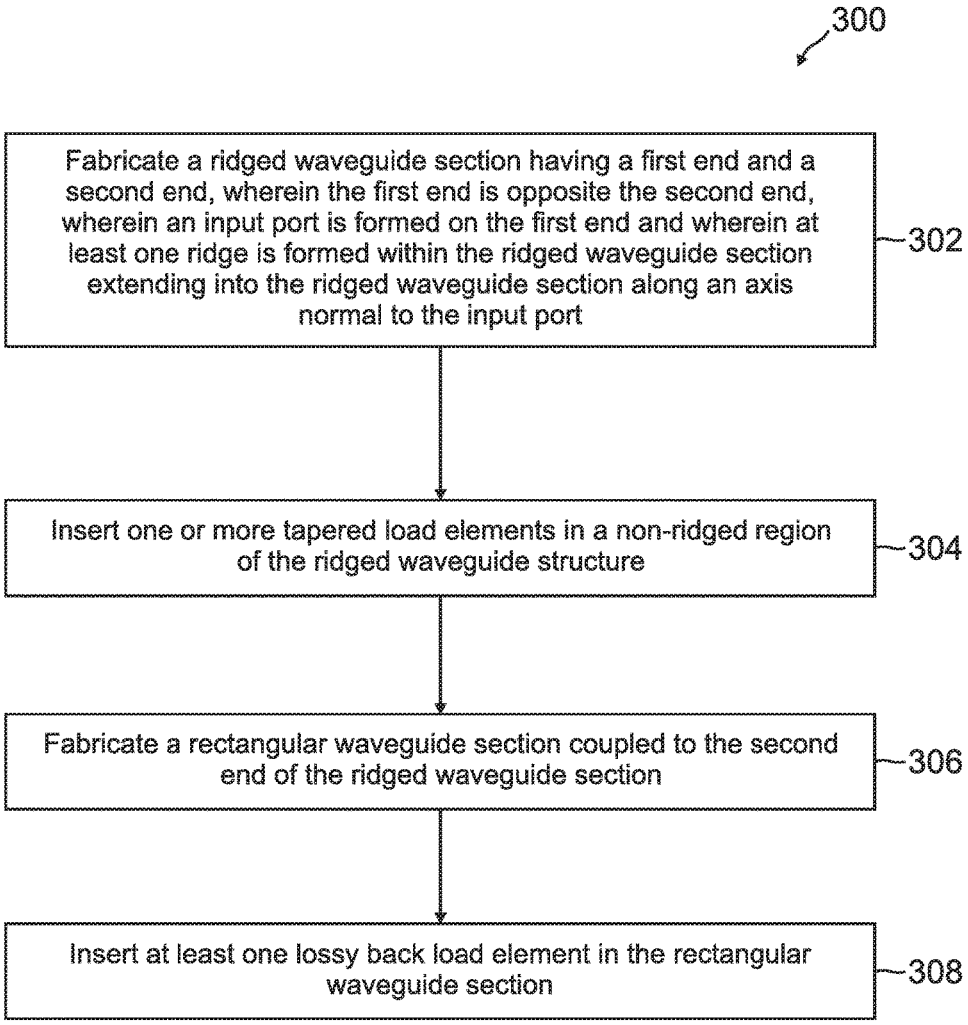
FIG. 3 is a flow diagram of an example method of manufacturing a waveguide.

FIG. 3 is a flow diagram of an example method 300 of manufacturing a waveguide such as but not limited to the waveguide 100 disclosed with respect to FIGS. 1 and 2. It should be understood that method 300 may be implemented in conjunction with any of the various embodiments and implementations described in this disclosure above or below. As such, elements of method 300 may be used in conjunction with, in combination with, or substituted for elements of those embodiments. Further, the functions, structures and other description of elements for such embodiments described herein may apply to like named elements of method 300 and vice versa.

Method 300 begins at block 302 with fabricating a ridged waveguide section having a first end and a second end, wherein the first end is opposite the second end, wherein an input port is formed on the first end and wherein at least one ridge is formed within the ridged waveguide section extending into the ridged waveguide section along an axis 148 normal to the input port of the waveguide. In one implementation of method 300, fabrication of the ridged waveguide section further comprises fabricating a double ridged waveguide section, wherein a non-ridge region of the double ridged waveguide is divided into four quadrants. That is, two ridges protruding into the internal volume of the waveguide from opposing sides form an elongated ridge waveguide section having an H-shaped cross section.

Method 300 then proceeds to block 304 with inserting one or more tapered load elements in a non-ridge region of the ridged waveguide structure. In one implementation of method 300 wherein the ridged waveguide is divided into four quadrants, inserting one or more tapered load elements in a non-ridge region of the ridged waveguide structure further comprises inserting a tapered load element in each quadrant. The tapered load elements have a thin edge and a thick edge, wherein the thick edge is opposite the thin edge. The tapered load elements are inserted such that the thin edge is closer to the input port and the thick edge is farther away from the input port. The one or more tapered load elements are composed of a material configured to absorb a first portion of power propagating through the waveguide.

Method 300 then proceeds to block 306 with fabricating a rectangular waveguide section adjacent to the second end of the ridged waveguide section. Method 300 then proceeds to block 308 with inserting at least one lossy back load element in the rectangular waveguide section. In one implementation of method 300, inserting at least one lossy back load element in the rectangular waveguide section further comprises inserting at least one rectangular load element in the rectangular waveguide. The at least one lossy back load element is composed of a material configured to absorb a second portion of power propagating through the waveguide. In some implementations, the second portion of power propagating through the waveguide is the power that remains unabsorbed after the one or more tapered load elements have absorbed the first portion of the power.

In some implementations, method 300 further comprises attaching the at least one lossy back load element and/or the one or more tapered load element to a housing of the waveguide. In some implementations, attaching the at least one lossy back load element and/or the one or more tapered load element to a housing of the waveguide further comprises bonding the at least one lossy back load element and/or the one or more tapered load element to a housing of the waveguide. In example embodiments, when the at least one lossy back load element and/or the one or more tapered load element are composed of a high temperature absorptive material, a special thermal epoxy is used for bonding. In some implementations, attaching the at least one lossy back load element and/or the one or more tapered load element to a housing of the waveguide further comprises fastening the at least one lossy back load element and/or the one or more tapered load element to a housing of the waveguide with one or more screws.

In one implementation, method 300 further comprises adjusting height, weight, and length dimensions of the at least one lossy back load element, one or more tapered load elements, rectangular waveguide section and/or ridge waveguide section. In some implementations, method 300 further comprises adding additional E-plane or H-plane tapers until desired return loss performance is met over a temperature and frequency range.

Example Embodiments

Example 1 includes a waveguide comprising: a ridged waveguide section having a first end and an opposing second end, wherein the ridged waveguide section comprises an input port at the first end of the ridged waveguide section, and wherein the ridged waveguide section comprises at least one ridge formed within the ridged waveguide section extending into the ridged waveguide section along an axis normal to the input port; a rectangular waveguide section coupled to the second end of the ridged waveguide section; at least one tapered load element located in a non-ridge region of the ridged waveguide section, wherein the at least one tapered load element comprises a material configured to absorb a first portion of power propagating through the waveguide; and at least one lossy back load element within the rectangular waveguide section, wherein the at least one lossy back load element comprises a material configured to absorb a second portion of the power propagating through the waveguide.

Example 2 includes the waveguide of Example 1, wherein the at least one lossy back load element is a rectangular load element.

Example 3 includes the waveguide of any of Examples 1-2, wherein the at least one lossy back load element is shorter and narrower in dimensions than the rectangular waveguide section.

Example 4 includes the waveguide of any of Examples 1-3, wherein the at least one lossy back load element has a thickness less than or equal to ten percent of a length of the at least one tapered load element, wherein the length of the at least one tapered load element is measured from tip of a thin edge of the at least one tapered load element to thick edge of the at least one tapered load element.

Example 5 includes the waveguide of any of Examples 1-4, wherein at least one of the at least one lossy back load element and the at least one tapered load element is composed of a high temperature absorptive material rated to higher than 260 Celsius.

Example 6 includes the waveguide of Example 5, wherein the high temperature absorptive material is rated to at least 1000 Celsius.

Example 7 includes the waveguide of any of Examples 1-6, wherein at least one of the at least one lossy back load element and the at least one tapered load element is composed of a low temperature absorptive material.

Example 8 includes the waveguide of any of Examples 1-7, wherein the non-ridge region of ridged waveguide section has four quadrants and each quadrant includes a tapered load element.

Example 9 includes the waveguide of any of Examples 1-8, wherein the at least one lossy back load element is composed of the same absorptive material as the at least one tapered load element.

Example 10 includes the waveguide of any of Examples 1-9, wherein the at least one lossy back load is adjacent to the at least one tapered load element.

Example 11 includes the waveguide of any of Examples 1-10, wherein the at least one lossy back load is spaced at least Example 0.25 millimeters from the at least one tapered load element.

Example 12 includes the waveguide of any of Examples 1-11, wherein the at least one tapered load element has a length less than 2 inches, wherein the length of the at least one tapered load element is measured from tip of a thin edge of the at least one tapered load element to thick edge of the at least one tapered load element.

Example 13 includes a method of manufacturing a waveguide, method comprising: fabricating a ridged waveguide section having a first end and a second end, wherein the first end is opposite the second end, wherein an input port is formed on the first end and wherein at least one ridge is formed within the ridged waveguide section extending into the ridged waveguide section along an axis normal to the input port; inserting one or more tapered load elements in a non-ridge region of the ridged waveguide structure; fabricating a rectangular waveguide section coupled to the second end of the ridged waveguide section; inserting at least one lossy back load element in the rectangular waveguide section; and wherein the one or more tapered load elements comprise a material configured to absorb a first portion of power propagating through the waveguide and the at least one lossy back load element comprises a material configured to absorb a second portion of power propagating through the waveguide.

Example 14 includes the method of Example 13, wherein inserting at least one lossy back load element in the rectangular waveguide section further comprises inserting at least one rectangular load element in the rectangular waveguide.

Example 15 includes the method of any of Examples 13-14, wherein fabricating a ridged waveguide section further comprises fabricating a double ridged waveguide section having four quadrants in the non-ridge region; and wherein inserting one or more tapered load elements in a non-ridge region of the ridged waveguide structure further comprises inserting a tapered load element in each quadrant.

Example 16 includes the waveguide of any of Examples 13-15, wherein at least one of the at least one lossy back load element and the at least one tapered load element is composed of a high temperature absorptive material rated to higher than 260° C.

Example 17 includes the method of any of Examples 13-16, further comprising attaching the at least one lossy back load element and the one or more tapered load elements to a housing of the waveguide.

Example 18 includes the method of any of Examples 13-17, wherein at least one of the at least one lossy back load element and the one or more tapered load elements is composed of a high temperature absorptive material rated to higher than 260° C.

Example 19 includes a ridged waveguide, the ridged waveguide comprising: a double ridged waveguide section having a first end and an opposing second end, wherein the double ridged waveguide section comprises an input port at the first end of the double ridged waveguide section, wherein the ridge waveguide section has a first ridge formed within the ridged waveguide section extending into the ridged waveguide section along an axis normal to the input port and an opposing second ridge formed within the ridged waveguide section extending into the ridged waveguide section along the axis normal to the input port, and wherein the first and second ridges divide non-ridge regions of the double ridged waveguide section into four quadrants; a rectangular waveguide section coupled to the second end of the double ridged waveguide section; a first tapered load element positioned in a first quadrant of the four quadrants; a second tapered load element positioned in a second quadrant of the four quadrants; a third tapered load element positioned in a third quadrant of the four quadrants; a fourth tapered load element positioned in a fourth quadrant of the four quadrants; wherein the first, second, third and fourth tapered load elements comprise a material configured to absorb a first portion of power propagating through the waveguide; and at least one lossy back load element positioned within the rectangular waveguide section, wherein the at least one lossy back load element comprises a material configured to absorb a second portion of the power propagating through the waveguide.

Example 20 includes the ridge waveguide of Example 19, wherein the first tapered load element, second tapered load element, third tapered load element, and fourth tapered load element are composed of the same material as the at least one lossy back load element.

Embodiments of the example waveguides described in the present description can be used in various applications including power dividers and circulators. For example, the exemplary waveguides provided herein may be used to terminate the unused ports on four port power dividers when used for splitting of power to multiple antennas and/or to terminate the isolated ports on circulators for use as isolators.

What is claimed is:

1. A waveguide comprising:

a ridged waveguide section having a first end and an opposing second end, wherein the ridged waveguide section comprises an input port at the first end of the ridged waveguide section, and wherein the ridged waveguide section comprises at least one ridge formed within the ridged waveguide section extending into the ridged waveguide section along an axis normal to the input port;

a rectangular waveguide section coupled to the second end of the ridged waveguide section;

at least one tapered load element located in a non-ridge region of the ridged waveguide section, wherein the at least one tapered load element comprises a material configured to absorb a first portion of power propagating through the waveguide; and at least one lossy back load element within the rectangular waveguide section, wherein the at least one lossy back load element comprises a material configured to absorb a second portion of the power propagating through the waveguide.

2. The waveguide of claim 1, wherein the at least one lossy back load element is a rectangular load element.

3. The waveguide of claim 1, wherein the at least one lossy back load element is shorter and narrower in dimensions than the rectangular waveguide section.

4. The waveguide of claim 1, wherein the at least one lossy back load element has a thickness less than or equal to ten percent of a length of the at least one tapered load element, wherein the length of the at least one tapered load element is measured from tip of a thin edge of the at least one tapered load element to thick edge of the at least one tapered load element.

5. The waveguide of claim 1, wherein at least one of the at least one lossy back load element and the at least one tapered load element is composed of a high temperature absorptive material rated to higher than 260 Celsius.

6. The waveguide of claim 5, wherein the high temperature absorptive material is rated to at least 1000 Celsius.

7. The waveguide of claim 1, wherein at least one of the at least one lossy back load element and the at least one tapered load element is composed of a low temperature absorptive material.

8. The waveguide of claim 1, wherein the non-ridge region of ridged waveguide section has four quadrants and each quadrant includes a tapered load element.

9. The waveguide of claim 1, wherein the at least one lossy back load element is composed of the same absorptive material as the at least one tapered load element.

10. The waveguide of claim 1, wherein the at least one lossy back load is adjacent to the at least one tapered load element.

11. The waveguide of claim 1, wherein the at least one lossy back load is spaced at least 0.25 millimeters from the at least one tapered load element.

12. The waveguide of claim 1, wherein the at least one tapered load element has a length less than 2 inches, wherein the length of the at least one tapered load element is measured from tip of a thin edge of the at least one tapered load element to thick edge of the at least one tapered load element.

13. A method of manufacturing a waveguide, method comprising:

fabricating a ridged waveguide section having a first end and a second end, wherein the first end is opposite the second end, wherein an input port is formed on the first end and wherein at least one ridge is formed within the ridged waveguide section extending into the ridged waveguide section along an axis normal to the input port;

inserting one or more tapered load elements in a non-ridge region of the ridged waveguide structure;

fabricating a rectangular waveguide section coupled to the second end of the ridged waveguide section;

inserting at least one lossy back load element in the rectangular waveguide section; and wherein the one or more tapered load elements comprise a material configured to absorb a first portion of power propagating through the waveguide and the at least one lossy back load element comprises a material configured to absorb a second portion of power propagating through the waveguide.

14. The method of claim 13, wherein inserting at least one lossy back load element in the rectangular waveguide section further comprises inserting at least one rectangular load element in the rectangular waveguide.

15. The method of claim 13, wherein fabricating a ridged waveguide section further comprises fabricating a double ridged waveguide section having four quadrants in the non-ridge region; and wherein inserting one or more tapered load elements in a non-ridge region of the ridged waveguide structure further comprises inserting a tapered load element in each quadrant.

16. The waveguide of claim 13, wherein at least one of the at least one lossy back load element and the at least one tapered load element is composed of a high temperature absorptive material rated to higher than 260° C.

17. The method of claim 13, further comprising attaching the at least one lossy back load element and the one or more tapered load elements to a housing of the waveguide.

18. The method of claim 13, wherein at least one of the at least one lossy back load element and the one or more tapered load elements is composed of a high temperature absorptive material rated to higher than 260° C.

19. A ridged waveguide, the ridged waveguide comprising:

a double ridged waveguide section having a first end and an opposing second end, wherein the double ridged waveguide section comprises an input port at the first end of the double ridged waveguide section, wherein the ridge waveguide section has a first ridge formed within the ridged waveguide section extending into the ridged waveguide section along an axis normal to the input port and an opposing second ridge formed within the ridged waveguide section extending into the ridged waveguide section along the axis normal to the input port, and wherein the first and second ridges divide non-ridge regions of the double ridged waveguide section into four quadrants;

a rectangular waveguide section coupled to the second end of the double ridged waveguide section;

a first tapered load element positioned in a first quadrant of the four quadrants;

a second tapered load element positioned in a second quadrant of the four quadrants;

a third tapered load element positioned in a third quadrant of the four quadrants;

a fourth tapered load element positioned in a fourth quadrant of the four quadrants;

wherein the first, second, third and fourth tapered load elements comprise a material configured to absorb a first portion of power propagating through the waveguide; and at least one lossy back load element positioned within the rectangular waveguide section, wherein the at least one lossy back load element comprises a material configured to absorb a second portion of the power propagating through the waveguide.

20. The ridge waveguide of claim 19, wherein the first tapered load element, second tapered load element, third tapered load element, and fourth tapered load element are composed of the same material as the at least one lossy back load element.

* * * * *